US011246399B2

(12) United States Patent
Xi et al.

(10) Patent No.: US 11,246,399 B2
(45) Date of Patent: Feb. 15, 2022

(54) BRISTLE FOR AN ORAL CARE IMPLEMENT

(71) Applicant: Colgate-Palmolive Company, New York, NY (US)

(72) Inventors: Wen Jin Xi, Shanghai (CN); Yan Mei Ji, Jiangsu (CN)

(73) Assignee: Colgate-Palmolive Company, New York, NY (US)

( * ) Notice: Subject to any disclaimer, the term of this patent is extended or adjusted under 35 U.S.C. 154(b) by 156 days.

(21) Appl. No.: 16/646,179

(22) PCT Filed: Sep. 11, 2018

(86) PCT No.: PCT/US2018/050338
§ 371 (c)(1),
(2) Date: Mar. 11, 2020

(87) PCT Pub. No.: WO2019/055368
PCT Pub. Date: Mar. 21, 2019

(65) Prior Publication Data

US 2020/0275767 A1 Sep. 3, 2020

(30) Foreign Application Priority Data

Sep. 15, 2017 (CN) ..... 201710839780.2

(51) Int. Cl.
*A46B 9/04* (2006.01)
*A46D 1/00* (2006.01)

(52) U.S. Cl.
CPC ..... *A46B 9/04* (2013.01); *A46D 1/0238* (2013.01); *A46D 1/0276* (2013.01); *A46B 2200/1066* (2013.01)

(58) Field of Classification Search
CPC ..... A46B 9/04; A46B 2200/1066; A46D 1/0238; A46D 1/0276
See application file for complete search history.

(56) References Cited

U.S. PATENT DOCUMENTS 1,773,969 A 8/1930 Dreyfus et al.
2,317,485 A * 4/1943 Rider ..... A46D 1/00 15/167.1

(Continued)

FOREIGN PATENT DOCUMENTS

CN 1079020 C 2/2002
CN 203028453 U 7/2013

(Continued)

OTHER PUBLICATIONS

International Search Report and Written Opinion of the International Searching Authority in International Application PCT/US2018/050338, dated Dec. 13, 2018.

*Primary Examiner* — Weilun Lo

(57) ABSTRACT

A bristle for an oral care implement and an oral care implement including a plurality of such bristles. The bristle may include a body extending along a longitudinal axis from a proximal end to a distal end, the body having tapered portion having a transverse cross-sectional profile with a perimeter defined by a first linear section and a second linear section that intersect to form a first apex, a third linear section and a fourth linear section that intersect to form a second apex, a first curved section extending between the first and third linear sections, and a second curved section extending between the second and fourth linear sections. The body may also include a cylindrical body portion such that the tapered portion extends from a top end of the cylindrical body portion. The bristle includes various edges and rounded contours for enhanced cleaning.

19 Claims, 10 Drawing Sheets

(56) References Cited

U.S. PATENT DOCUMENTS

| | | | | |
|---|---|---|---|---|
| 5,459,899 | A | 10/1995 | Bauer | |
| 5,531,582 | A | 7/1996 | Klinkhammer | |
| 5,926,900 | A | 7/1999 | Bennett | |
| 5,933,908 | A * | 8/1999 | O'Brien | A46D 1/0246 15/207.2 |
| 6,732,398 | B2 | 5/2004 | McConnell | |
| 7,503,093 | B2 | 3/2009 | Weihrauch | |
| 7,644,466 | B2 | 1/2010 | Weihrauch | |
| 8,528,148 | B2 | 9/2013 | Brown | |
| 8,677,541 | B2 | 3/2014 | Meadows et al. | |
| 9,210,995 | B2 | 12/2015 | Su et al. | |
| 9,750,334 | B2 | 9/2017 | Kirchhofer et al. | |
| 10,213,011 | B2 | 2/2019 | Moskovich | |
| 2007/0289078 | A1* | 12/2007 | Driesen | A46D 1/0269 15/207.2 |
| 2009/0083925 | A1 | 4/2009 | Mathiez | |
| 2013/0291326 | A1* | 11/2013 | Mintel | B01L 3/527 15/167.1 |
| 2015/0033486 | A1* | 2/2015 | Chiou | A46B 9/04 15/167.1 |
| 2017/0164724 | A1* | 6/2017 | Moskovich | A46D 1/0261 |

FOREIGN PATENT DOCUMENTS

| | | |
|---|---|---|
| CN | 203776358 U | 8/2014 |
| CN | 204378291 U | 6/2015 |
| DE | 19942147 | 3/2001 |
| EP | 2002753 | 12/2008 |
| GB | 318631 | 8/1930 |
| JP | 2006149419 | 6/2006 |
| RU | 2006141299 | 5/2008 |
| WO | 1996/009781 | 4/1996 |

* cited by examiner

BRISTLE FOR AN ORAL CARE IMPLEMENT

BACKGROUND

Conventional toothbrushes include a head with tooth cleaning elements thereon. In typical toothbrushes, the tooth cleaning elements are bristles formed of nylon or a similar filament material. Due to the small diameter of such nylon bristles, a toothbrush may include thousands of discrete bristles arranged in tufts and coupled to the head, each of the discrete bristles forming a distinct end-point for cleaning. Recently, toothbrushes have been manufactured with the bristles formed via injection molding. In such toothbrushes, the bristles are much larger than conventional filament bristles and as a result there are many fewer bristles on the head, which results in fewer end-points for cleaning. However, injection molding technologies allow for such bristles to be formed in a wide variety of different shapes with different cross-sections along the length of the bristle. Thus, a need exists for injection molded bristles for a toothbrush having an optimal shape for both cleaning and prolonging the life cycle of the bristles.

BRIEF SUMMARY

The present invention may be directed to a bristle for an oral care implement. The bristle may be formed of an elastomeric material via an injection molding process. The bristle may include various axial portions having different cross-sectional shapes. Specifically, the bristle may include a non-tapered cylindrical body portion, a tapered first axial portion, and a tapered second axial portion. The first and second axial portions may have edges and curved surfaces.

In one aspect, the invention may be a bristle for an oral care implement comprising: a body extending along a longitudinal axis from a proximal end to a distal end, the body comprising: a first axial portion comprising a first transverse cross-sectional profile having a perimeter defined by a first linear section and a second linear section that intersect to form a first apex, a third linear section and a fourth linear section that intersect to form a second apex, a first curved section extending between the first and third linear sections, and a second curved section extending between the second and fourth linear sections; and a second axial portion comprising a second transverse cross-sectional profile having a perimeter defined by a third apex, a fourth apex, a third curved section, and a fourth curved section, the third and fourth curved sections intersecting to form the third and fourth apexes.

In another aspect, the invention may be a bristle for an oral care implement comprising: a body extending along a longitudinal axis from a proximal end to a distal end, the body comprising: a cylindrical base portion comprising the proximal end of the body; a first axial portion extending from the cylindrical base portion, the first axial portion comprising at least one edge elongated along the longitudinal axis and at least one curved surface; and a second axial portion extending from the first axial portion and comprising the distal end of the body, the second axial portion comprising at least one edge elongated along the longitudinal axis and at least one curved surface.

In yet another aspect, the invention may be a bristle for an oral care implement comprising: an elastomeric body extending along a longitudinal axis from a proximal end to a distal end, the elastomeric body comprising: a cylindrical base portion extending from the proximal end of the elastomeric body to a top end; and a tapered portion extending from the top end of the cylindrical base portion to the distal end of the elastomeric body, the top end of the cylindrical base portion forming an annular shoulder that circumferentially surrounds the tapered portion, the tapered portion comprising a first edge and a second edge that are circumferentially spaced apart from one another, the first and second edges being elongated along the tapered portion in a direction of the longitudinal axis.

In a further aspect, the invention may be a bristle for an oral care implement comprising: a body extending along a longitudinal axis from a proximal end to a distal end, the body comprising a transverse cross-sectional profile having a perimeter defined by a first linear section and a second linear section that intersect to form a first apex, a third linear section and a fourth linear section that intersect to form a second apex, a first curved section extending between the first and third linear sections, and a second curved section extending between the second and fourth linear sections.

In a still further aspect, the invention may be a bristle for an oral care implement comprising: a body extending along a longitudinal axis from a proximal end to a distal end, the body comprising a first axial portion comprising at least one edge elongated along the longitudinal axis and at least one curved surface.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
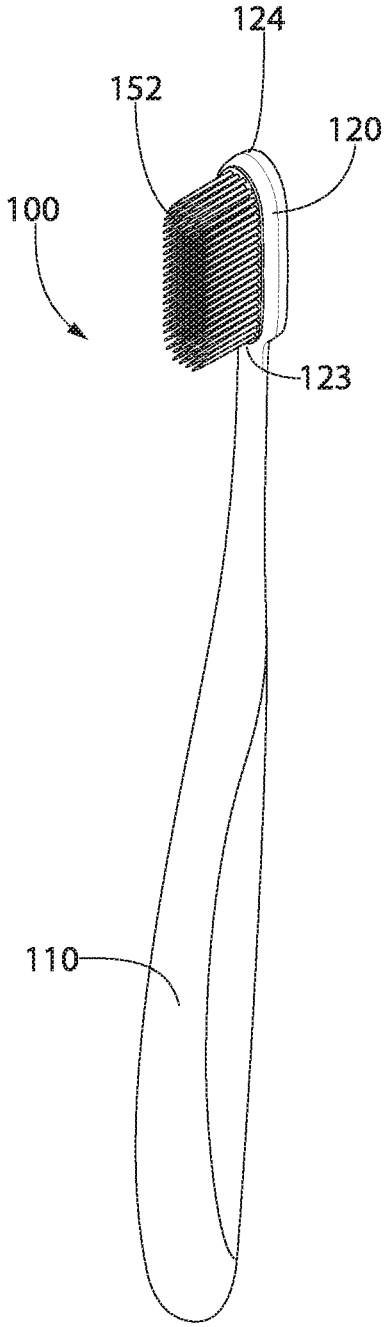
FIG. 1 is a front perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Figure 2:
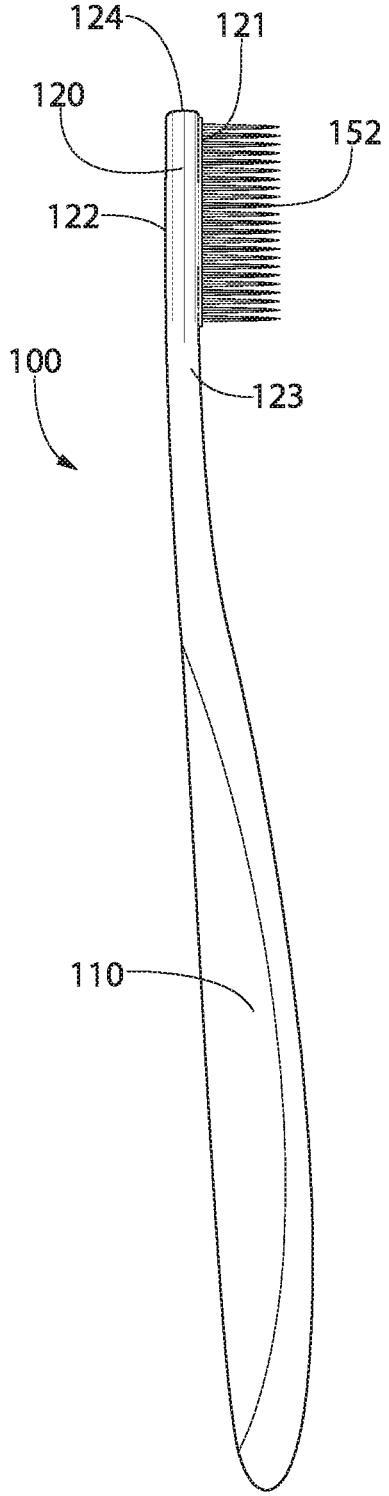
FIG. 2 is a side view of the oral care implement of FIG. 1.
Figure 3:
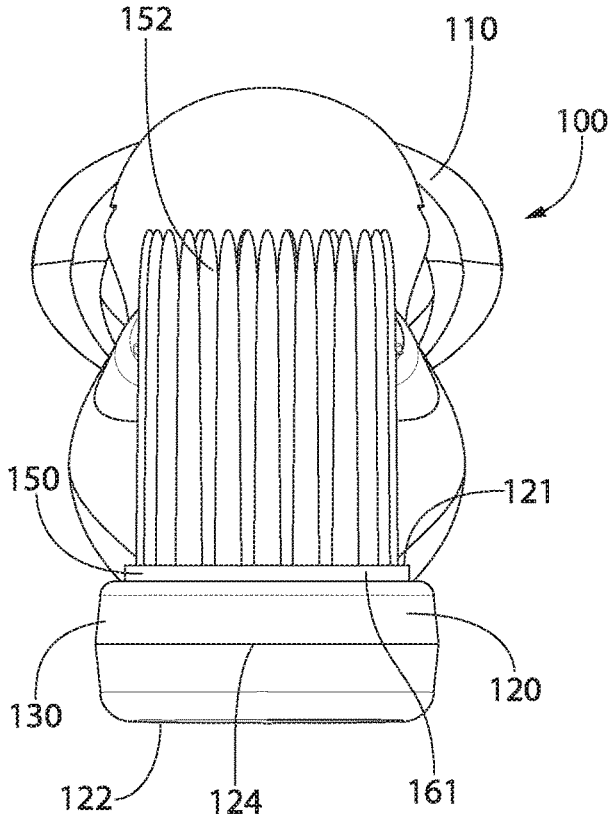
FIG. 3 is a top view of the oral care implement of FIG. 1.
Figure 4:
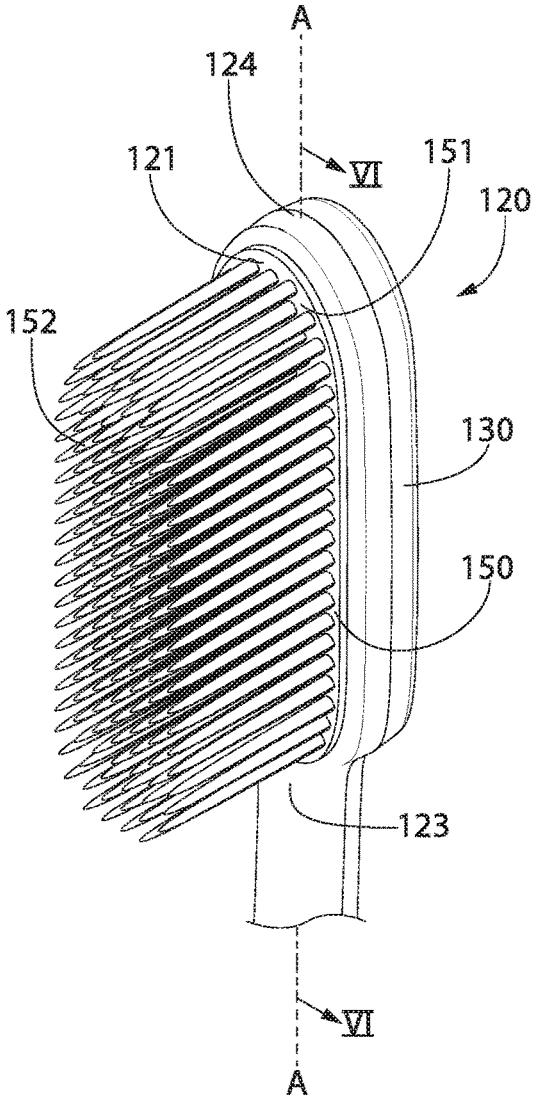
FIG. 4 is a close-up view of a head of the oral care implement of FIG. 1.

Referring to FIGS. 1-3, an oral care implement 100 will be described in accordance with an embodiment of the present application. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having cleaning elements, or any other type of implement that is commonly used for oral care.

The oral care implement 100 generally comprises a handle 110 and a head 120. The handle 110 is an elongated structure that provides the mechanism by which the user can hold and manipulate the oral care implement 100 during use. In the exemplified embodiment, the handle 110 is generically depicted having various contours for user comfort. Of course, the invention is not to be limited by the specific shape illustrated for the handle 110 in all embodiments and in certain other embodiments the handle 110 can take on a wide variety of shapes, contours, and configurations, none of which are limiting of the present invention unless so specified in the claims.

The handle 110 may include a base formed of a hard or rigid plastic material, such as for example without limitation polymers and copolymers of ethylene, propylene, butadiene, vinyl compounds, and polyesters such as polyethylene terephthalate. In certain embodiments, the base of the handle 110 may be a homogeneous polypropylene such as an S700 type polypropylene. The handle 110 may also include a grip that is formed of a resilient/elastomeric material, such as a thermoplastic elastomer. Such a grip may be molded over a portion of the base of the handle 110 that is typically gripped by a user's thumb and forefinger during use. Furthermore, it should be appreciated that additional regions of the handle 110 can be overmolded with the resilient/elastomeric material to enhance the gripability of the handle 110 during use. For example, portions of the handle 110 that are typically gripped by a user's palm during use may be overmolded with a thermoplastic elastomer or other resilient material to further increase comfort to a user. Furthermore, materials other than those noted above can be used to form the handle 110, including metal, wood, or any other desired material that has sufficient structural rigidity to permit a user to grip the handle 110 and manipulate the oral care implement 100 during toothbrushing. However, plastic materials such as those noted above may be preferred in some embodiments to impart the desired flexibility onto the head 120 to enhance deep mouth cleaning.

Referring to FIGS. 1-4 concurrently, the head 120 of the oral care implement 100 will be described. The head 120 of the oral care implement 100 is coupled to the handle 110 and comprises an exposed front surface 121 and an exposed rear surface 122 that is opposite the exposed front surface 121. The head 120 extends along a longitudinal axis A-A from a proximal end 123 that is coupled to the handle 110 to a distal end 124. The head 120 of the oral care implement 100 comprises a support structure 130 and a monolithic cleaning unit 150, both of which will be described in more detail below. In the exemplified embodiment, the support structure 130 of the head 120 is formed integrally with the handle 110 and the monolithic cleaning unit 150 is formed separately (although it may be injection molded directly onto the support structure 130 in some embodiments).

Specifically, in the exemplified embodiment the support structure 130 of the head 120 and the handle 110 are formed as a single unitary structure using a molding, milling, machining, or other suitable process. However, in other embodiments the handle 110 and the support structure 130 of the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. Thus, the support structure 130 of the head 120 may, in certain embodiments, be formed of any of the rigid plastic materials described above as being used for forming the handle 110, although the invention is not to be so limited in all embodiments and other materials that are commonly used during toothbrush head manufacture may also be used. The monolithic cleaning unit 150 may, in certain embodiments, be injection molded directly onto the support structure 130 to form the fully assembled head 120.

As noted above, the monolithic cleaning unit 150 is coupled to the support structure 130 so that the monolithic cleaning unit 150 and the support structure 130 collectively form the head 120. In the exemplified embodiment, both the monolithic cleaning unit 150 and the support structure 130 form a portion of the exposed front surface 121 and the exposed rear surface 122 of the head 120. Of course, other structural arrangements are possible including having only one of the monolithic cleaning unit 150 and the support structure 130 forming at least one of the exposed front and rear surfaces 121, 122 of the head 120. For example, the monolithic cleaning unit 150 may form the entirety of the exposed front and rear surfaces 121, 122 of the head 120, or the monolithic cleaning unit 150 may form the exposed front surface 121 while the support structure 130 forms the exposed rear surface. Other permutations are also possible.

The monolithic cleaning unit 150 generally comprises a pad 151 that is coupled directly to the support structure 130 and a plurality of bristles 152 extending from the pad 151. All of the bristles 152 and the pad 151 are integrally formed as a single unitary structure (i.e., the monolithic cleaning unit 150). Thus, the entire monolithic cleaning unit 150, including the pad 151 and all of the bristles 152, are integrally formed. In one embodiment, the monolithic cleaning unit 150 may be formed of an elastomeric material, examples of which are provided below. Thus, the plurality of bristles 152 may be referred to herein as molded bristles, which is intended to mean that the bristles are formed of an elastomeric material. However, the bristles 152 need not be formed of an elastomeric material in all embodiments and may be formed as filament bristles (end-rounded, tapered, spiral, core-sheath, etc.) in other embodiments.

In certain embodiments, the monolithic cleaning unit 150 is injection molded onto the support structure 130 in a single shot. Thus, the pad 151 and each of the plurality of bristles 152 are integrally formed as a single unitary structure (i.e., the monolithic cleaning unit 150). Stated another way, the monolithic cleaning unit 150, including the pad 151 and the plurality of bristles 152, is a one-piece structure that is affixed to the support structure 130. In some embodiments, the bristles 152 are injection molded out of an elastomeric material. Thus, the bristles 152 may be referred to herein as injection molded bristles in some embodiments. In the exemplified embodiment, the monolithic cleaning unit 150 includes all of the bristles on the head 120. Thus, in the exemplified embodiment the head 120 does not include any bristles or other tooth cleaning elements that are not formed as an integral part of the monolithic cleaning unit 150. Stated another way, there are no filament bristles on the head 120, only the bristles 152 of the monolithic cleaning unit 150.

Of course, alternative embodiments are possible whereby the head 120 includes the monolithic cleaning unit 150 and its bristles 152 as well as additional bristles which may be filament bristles or the like. Thus, the bristles 152 may in some embodiments form some, but not all, of the cleaning elements on the head 120. Furthermore, as will be discussed in more detail below, in certain aspects the invention claimed herein is directed to a single bristle having a particular shape. Thus, such single bristle may be one that is formed as a part of the monolithic cleaning unit 150 or it may be an individual bristle that is not formed as a part of a larger structure such as the monolithic cleaning unit 150. Such an individual bristle is preferably a molded bristle or one that is formed of an elastomeric material, sometimes referred to in the literature as a lamella.

Figure 5:
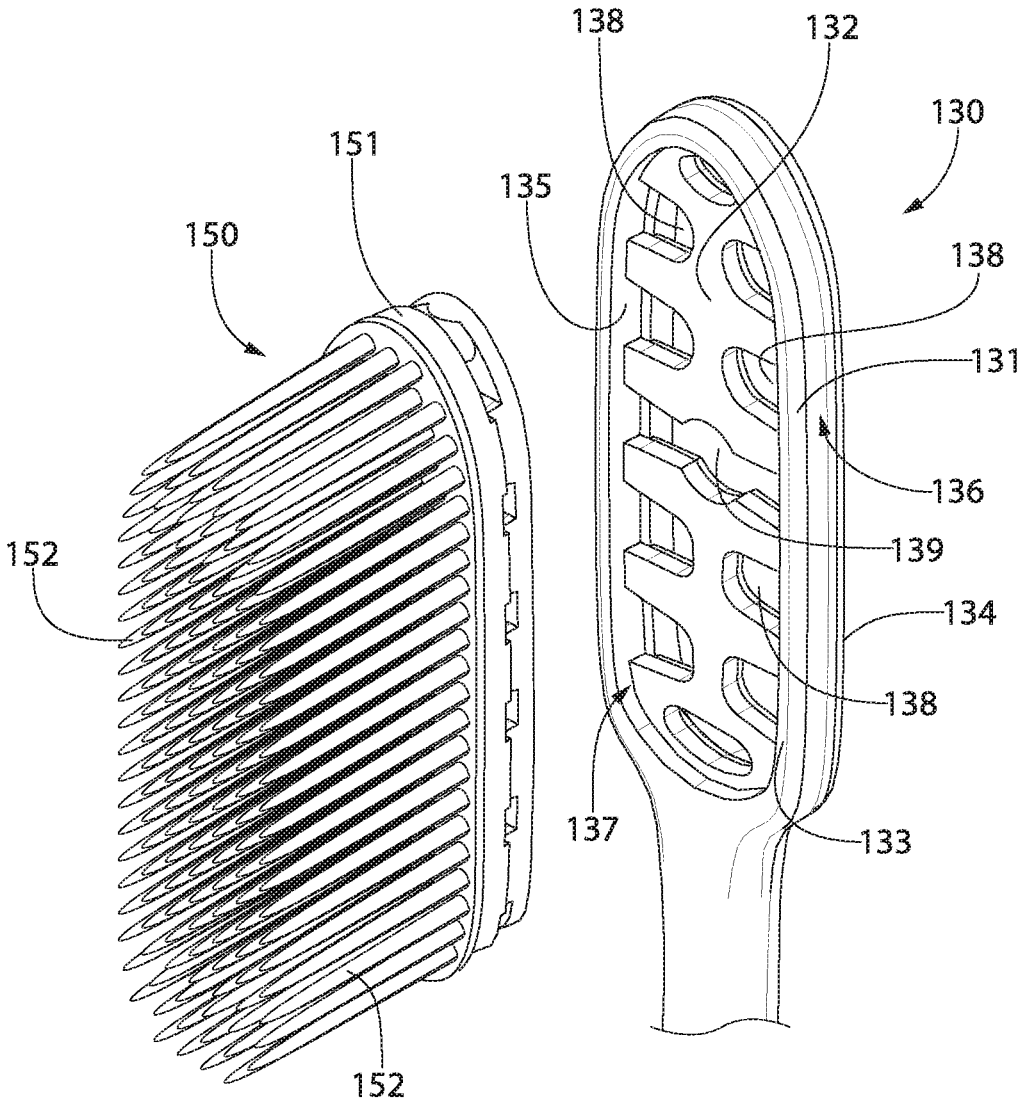
FIG. 5 is an exploded close-up view of the head of the oral care implement of FIG. 1.
Figure 6:
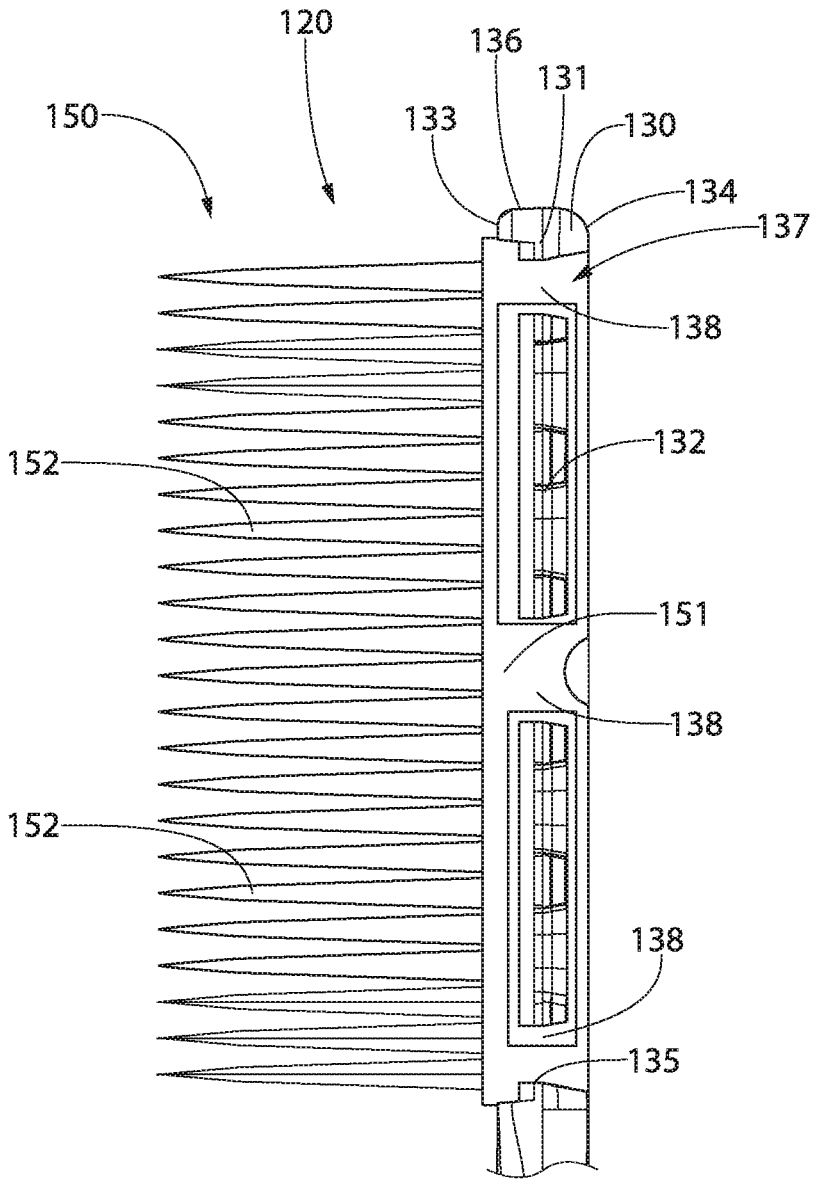
FIG. 6 is a cross-sectional view taken along line VI-VI of FIG. 4.

Referring to FIGS. 5 and 6, the head 120 will be further described. FIG. 5 illustrates the head 120 with the monolithic cleaning unit 150 exploded from the support structure 130 and FIG. 6 illustrates the head 120 in cross-section to show the cooperation between the pad 151 of the monolithic cleaning unit 150 and the support structure 130. The support structure 130 comprises a perimetric wall 131 and a support plate 132. In the exemplified embodiment, the perimetric wall 131 and the support plate 132 are integrally formed with each other and with the handle 110 in a single shot injection molding process or the like. The perimetric wall 131 comprises a front surface 133, a rear surface 134 opposite the front surface 133, an inner surface 135, and an outer surface 136 opposite the inner surface 134. The inner surface 135 of the perimetric wall 131 defines a central opening 137 that extends from the front surface 133 to the rear surface 134 of the perimetric wall 131.

As shown in FIG. 6, when the head 120 is fully formed, the pad 151 of the monolithic cleaning unit 150 is located within the central opening 137 of the perimetric wall 131. Generally, this is accomplished by positioning the support structure 130 into a mold cavity and injecting an elastomeric material into the central opening 137 to form the monolithic cleaning unit 150. However, other techniques may be possible, such as forming the monolithic cleaning unit 150 separately from the support structure 130 and then attaching it to the support structure 130. The outer surface 136 of the perimetric wall 131 forms the outer surface of the head 120 in the exemplified embodiment. Thus, the perimetric wall 131 forms a rim of the head 120 of the oral care implement 100 that surrounds the pad 151 of the monolithic cleaning unit 150. However, alternative embodiments are possible whereby the perimetric wall 131 is omitted and the support structure 130 comprises only the support plate 132 and not also the perimetric wall 131.

The support plate 132 is located within the central opening 137 of the perimetric wall 130 and is connected directly to the inner surface 135 of the perimetric wall 131. The support plate 132 spans the entire length and width of the central opening 137 with the exception of through-holes 138 that are formed into the support plate 132, but the support plate 132 does not span the entire thickness of the central opening 137. Rather, the support plate 132 is located entirely within the central opening 137 and does not protrude from either of the front and rear surfaces 133, 134 of the perimetric wall 131 because the support plate 132 is thinner than the perimetric wall 131. In that regard, the support plate 132 is recessed relative to both of the front and rear surfaces 133, 134 of the perimetric wall 131.

The through-holes 138 formed into the support plate 132 permit the monolithic cleaning unit 150 to be formed by injecting an elastomeric material into central opening 137 from one of the front or rear surfaces. Specifically, the elastomeric material will pass through the through-holes 138 to form the entirety of the pad 151 of the monolithic cleaning unit 150. The through-holes 138 also include at least one transverse through-hole 139 that divides the support plate 132 into two separate sections. The transverse through-hole 139 increases flexibly of the head 120 by having a reduction in the amount of hard plastic material at the location of the transverse through-hole 139.

Referring to FIGS. 2 and 3 collectively, the bristles 152 have different profiles depending on which direction they are being viewed from. Specifically, FIG. 2 is a side view of the head 120 (and a side view of the bristles 152) and FIG. 3 is a top view of the head 120 (and a front view of the bristles 152). The bristles 152 have a different profile depending on whether they are viewed from the side (FIG. 2) or the front (FIG. 3). Specifically, in the side view the bristles 152 taper to a point, whereas in the front view the bristles 152 taper but not to a point. Rather, in the front view the bristles 152 taper but still terminate in a rounded distal tip. Thus, the bristles 152 taper more rapidly in the side view than in the front view.

Figure 7:
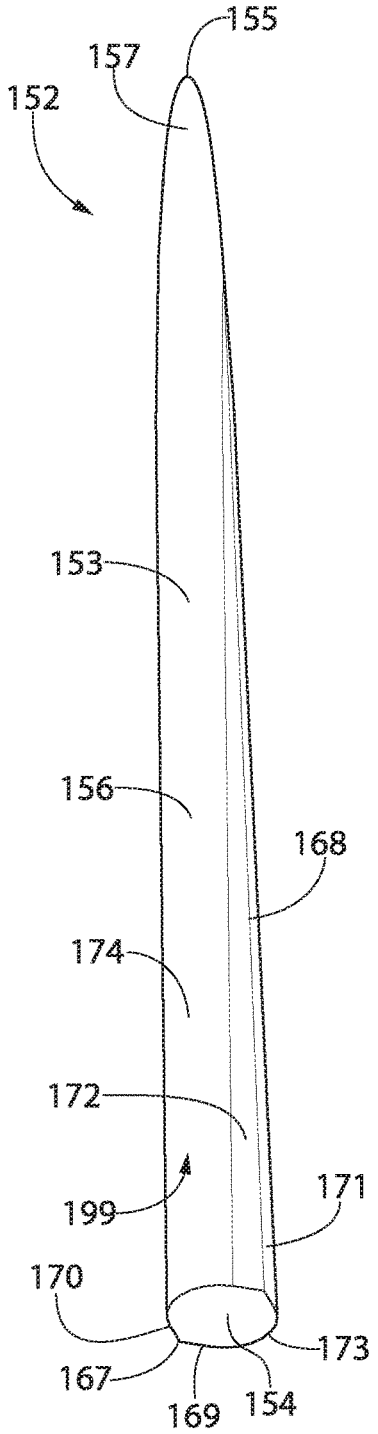
FIG. 7 is a perspective view of a bristle of the oral care implement of FIG. 1.
Figure 8A:
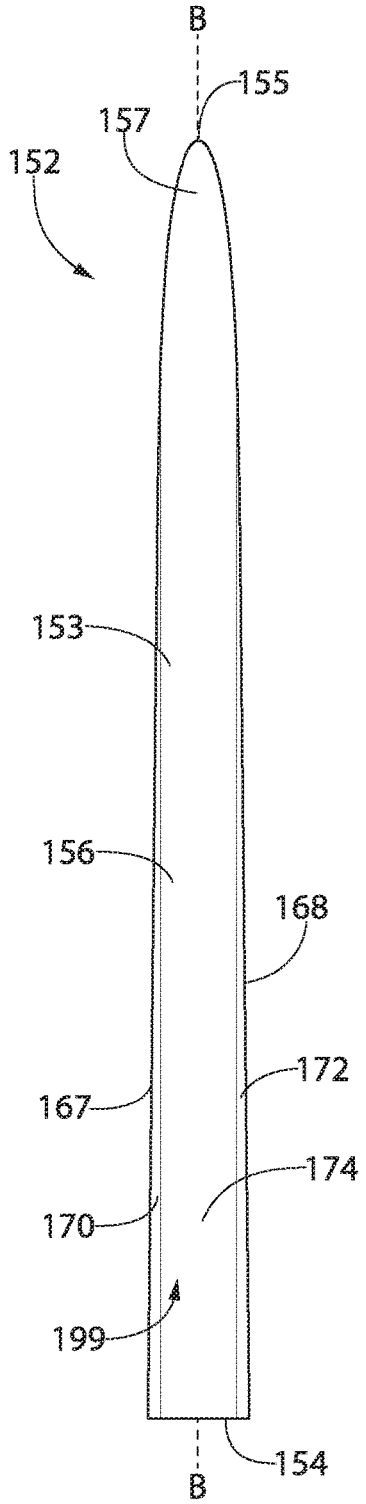
FIG. 8A is a front view of the bristle of FIG. 7.
Figure 8B:
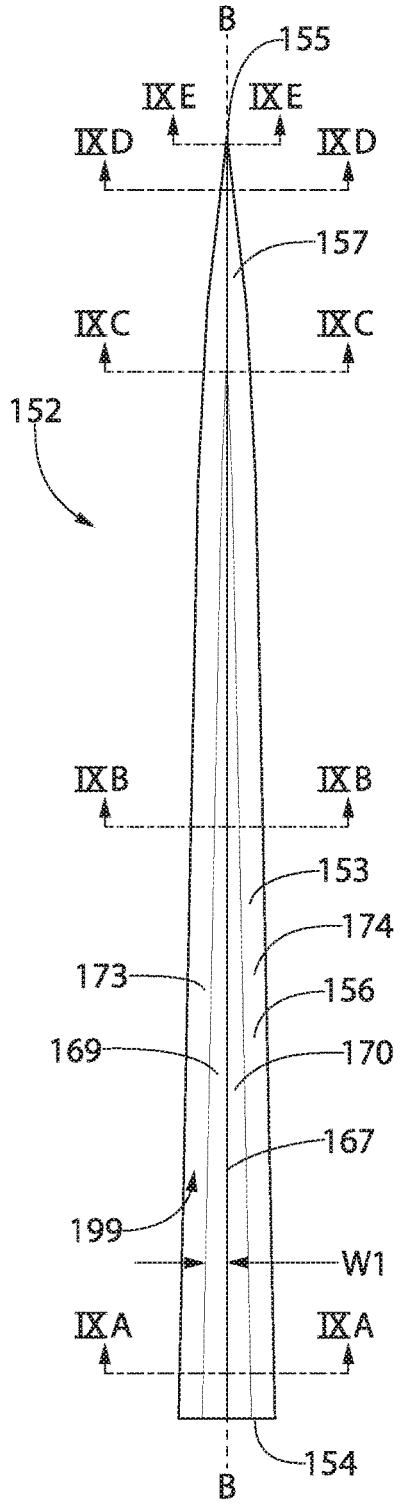
FIG. 8B is a side view of the bristle of FIG. 7.

Referring to FIGS. 7-8B, one of the bristles 152 is illustrated by itself removed from the monolithic cleaning unit 150. As mentioned above, the bristles 152 may be formed as an integral part of the monolithic cleaning unit 150 in some embodiments and in such embodiments the bristles 152 are molded bristles that are formed of an elastomeric material. However, in other embodiments the bristles 152 may be molded bristles formed of an elastomeric material that are not formed as a part of a monolithic cleaning unit. Such bristles may be separately coupled to a head of an oral care implement rather than as a part of a monolithic cleaning unit. Regardless, when the bristles 152 are formed of an elastomeric material, such elastomeric material may be thermoplastic polyurethane (TPU), thermoplastic elastomer (TPE), silicone, blends thereof, or the like. In certain embodiments, the elastomeric material may be TPU having a hardness value of Shore A 88-92. The aforementioned elastomeric materials may be used to form the entirety of the monolithic cleaning unit 150 when the monolithic cleaning unit 150 is included in the invention. In still other embodiments, the bristles 152 may not be formed of an elastomeric material at all, but rather may be formed of nylon, horse hair, fibers, or other materials typically used to form filament bristles.

The molded bristles 152 comprise a body 153 that extends along a longitudinal axis B-B from a proximal end 154 to a distal end 155. The body 153 may have a height measured from the proximal end 154 to the distal end 155 of between 5 mm and 20 mm, more specifically between 7 mm and 15 mm, still more specifically between 8 mm and 12 mm, and still more specifically between 9 mm and 11 mm. Furthermore, the body 153 tapers along its length and therefore has a maximum diameter at its proximal end 154. The maximum diameter of the body 153 may be less than 1.0 mm, more specifically between 8 mm and 9.5 mm in some embodiments. As described herein, the body 153 may have an oval-like shape and thus may have two different diameters. In such embodiments, the maximum diameter is the largest of those diameters.

In the exemplified embodiment, the body 153 comprises a first axial portion 156 and a second axial portion 157. The first and second axial portions 156, 157 are merely different sections of the body 153 that are divided at a specific axial location along the body 153. There is not necessarily a dividing line, and in fact in the exemplified embodiment the first and second axial portions 156, 157 of the body 153 are seamless in aesthetic appearance. The body 153 is merely conceptually separated into the first and second axial portions 156, 157 based on differences in structure, features, and/or shape of the body 153 along the different axial portions 156, 157.

In the exemplified embodiment, the first axial portion 156 comprises the proximal end 154 of the body 153 and the second axial portion 157 comprises the distal end 155 of the body 153. In this embodiment, the first and second axial portions 156, 157 can be distinguished based on their transverse cross-sectional shapes. Specifically, the first axial portion 156 has a first transverse cross-sectional shape and the second axial portion 157 has a second transverse cross-sectional shape, the first and second transverse cross-sectional shapes being different from one another. This will be better understood from the description that follows with particular reference to FIGS. 9A-9E.

Figure 9A:
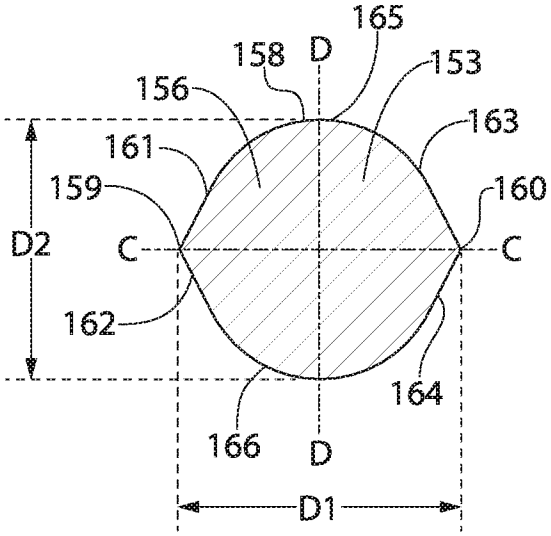
FIG. 9A is a cross-sectional view taken along line IXA-IXA of FIG. 8B.
Figure 9B:
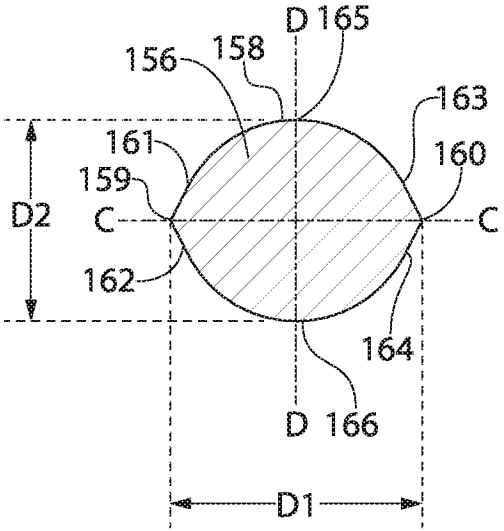
FIG. 9B is a cross-sectional view taken along line IXB-IXB of FIG. 8B.
Figure 9C:
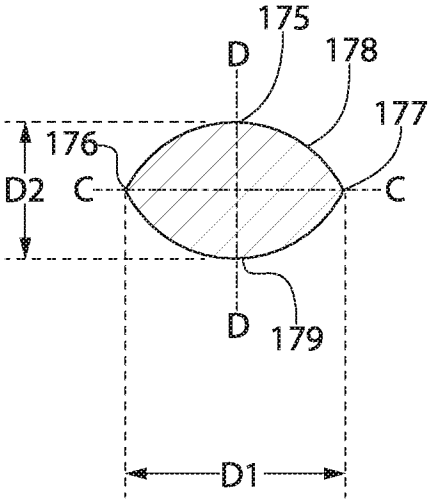
FIG. 9C is a cross-sectional view taken along line IXC-IXC of FIG. 8B.
Figure 9D:
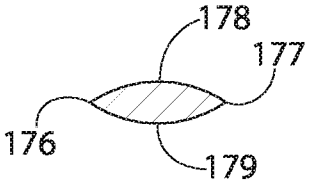
FIG. 9D is a cross-sectional view taken along line IXD-IXD of FIG. 8B.
Figure 9E:
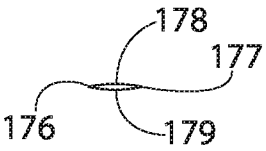
FIG. 9E is a cross-sectional view taken along line IXE-IXE of FIG. 8B.

Referring to FIGS. 9A-9E, transverse cross-sectional views are illustrated taken at different axial positions along the body 153 of the bristle 152. Specifically, FIGS. 9A and 9B are transverse cross-sections taken at different axial positions along the first axial portion 156 of the body 153, FIG. 9C is a transverse cross-section taken at the junction between the first and second axial portions 156, 157, and FIGS. 9D and 9E are transverse cross-sections taken at different axial positions along the second axial portion 157 of the body 153.

Turning first to FIGS. 9A and 9B, the first axial portion 156 comprises a first transverse cross-sectional profile having a perimeter 158 defined by a first apex 159, a second apex 160, a first linear section 161, a second linear section 162 a third linear section 163, a fourth linear section 164, a first curved section 165, and a second curved section 166. The first and second linear sections 161, 162 intersect to form the first apex 159 and the third and fourth linear sections 163, 164 intersect to form the second apex 160. The first curved section 165 extends from the first linear section 161 to the third linear section 163 and the second curved section 166 extends from the second linear section 162 to the fourth linear section 164. The first and second curved sections 165, 166 are convex in the exemplified embodiment, thus giving the first axial portion 156 of the body 153 a generally round shape. More specifically, in the exemplified embodiment the first axial portion 156 of the body 153 has a lemon-like transverse cross-sectional shape.

The shape of the first cross-sectional profile is not a polygon because it includes curved sides (i.e., the first and second curved sections 165, 166). However, using technical language typically used for polygons for ease of understanding, the first, second, third, and fourth linear sections 161-164 are each sides of the perimeter 158 and the first and second apexes 159, 160 are each vertices of the perimeter 158. Thus, the first, second, third, and fourth sections 161-164 may be referred to herein as "sides" and the first and second apexes 159, 160 may be referred to herein as "vertices."

In the exemplified embodiment, the first and second linear sections 161, 162 intersect and form an obtuse angle at the first apex 159. Similarly, the third and fourth linear sections 163, 164 intersect and form an obtuse angle at the second apex 160. Of course, other angles are possible including acute angles or perpendicular angles in alternative embodiments. A reference axis that extends along either of the first and third linear sections 161, 163 is tangent to a reference circle that includes the first curved section 165. A reference axis that extends along either of the second and fourth linear sections 162, 164 is tangent to a reference circle that includes the second curved section 166.

The first transverse cross-sectional profile of the first axial portion 156 comprises a first axis C-C that is perpendicular to the longitudinal axis A-A and a second axis D-D that is perpendicular to the longitudinal axis A-A. The first axis C-C is also perpendicular to the second axis D-D. In the exemplified embodiment, the first and second apexes 159, 160 are aligned along the first axis C-C and located on opposite sides of the second axis D-D. Furthermore, the first and third linear sections 161, 163 and the first curved section 165 are located on a first side of the first axis C-C and the second and fourth linear sections 162, 164 and the second curved section 166 are located on a second side of the first axis C-C. Additionally, the first apex 169 and the first and second linear sections 161, 162 are located on a first side of the second axis D-D and the second apex 160 and the third and fourth linear sections 163, 164 are located on a second side of the second axis D-D. The second axis D-D intersects both of the first and second curved sections 165, 166 of the perimeter 158. In the exemplified embodiment, the first transverse cross-sectional profile of the first axial portion 156 of the body 153 is symmetric about both of the first and second axes C-C, D-D.

It should be noted that the first transverse cross-sectional profile exists at any transverse cross-section taken along the first axial portion 156 of the body 153. Thus, although FIGS. 9A and 9B illustrate this cross-section at two axial locations along the first axial portion 156, the same shape exists when a cross-section is taken at any other location along the first axial portion 156 of the body 153. It is noted that although the transverse cross-sectional profile has the same shape regardless of the axial location along the first axial portion 156 at which the transverse cross-section is taken, the transverse cross-sectional area differs depending on the location at which the transverse cross-section is taken. This is because the first axial portion 156 of the body 153 tapers along its length, or its diameter decreases as it extends from the proximal end 154 of the body 153 towards the distal end 155 of the body 153. Thus, the transverse cross-sectional area of the first axial portion 156 decreases with increasing distance from the proximal end 154 towards the distal end 155.

The first axial portion 156 of the body 153 has a first diameter D1 measured along the first axis C-C and a second diameter D2 measured along the second axis D-D. The first and second diameters are generally unequal at any particular axial location along first axial portion 156 of the body 153. Thus, the first transverse cross-sectional profile is generally oval (i.e., lemon shaped as noted above) and not perfectly circular. In the exemplified embodiment, the first diameter D1 measured along the first axis C-C (which intersects the first and second apexes 159, 160) is greater than the second diameter D2 measured along the second axis D-D at all axial locations along the first axial portion 156. However, it is possible that a first transverse cross-sectional profile may exist at some location along the axial length of the first axial portion 156 at which the first and second diameters D1, D2 are the same.

In some embodiments, the maximum value of D1 at the thickest part of the bristle 152 may be between 0.8 mm and 1.0 mm, more specifically between 0.82 mm and 0.98 mm, and still more specifically between 0.83 mm and 0.93 mm. In some embodiments, the maximum value of D1 may be 0.83 mm and in other embodiments the maximum value of D1 may be approximately 0.94 mm. Furthermore, in some embodiments the maximum value of D2 at the thickest part of the bristle 152 may be between 0.75 mm and 1.0 mm. In some embodiments, the maximum value of D2 may be approximately 0.77 mm, and in other embodiments the maximum value of D2 may be approximately 0.97 mm. In some embodiments, the maximum value of D1 in the first axial portion 156 is between 0.82 and 0.84 mm, the minimum value of D1 in the first axial portion 156 is between 0.66 mm and 0.7 mm, the maximum value of D2 in the first axial portion 156 is between 0.75 mm and 0.8 mm and the minimum value of D2 in the first axial portion 156 is between 0.45 mm and 0.5 mm. In other embodiments, the maximum value of D1 in the first axial portion is between 0.92 mm and 0.96 mm, the minimum value of D1 in the first axial portion 156 is between 0.74 mm and 0.78 mm, the maximum value of D2 in the first axial portion 156 is between 0.95 mm and 1.0 mm, and the minimum value of D2 in the first axial portion is between 0.55 m and 0.6 mm.

Because the first axial portion 156 of the body 153 is tapered, each of the first and second diameters D1, D2 decreases the further from the proximal end 154 and the closer to the distal end 155 of the bristle 152 at which the diameter is taken. In certain embodiments, the first diameter D1 decreases moving towards the distal end 155 at a first average rate and the second diameter D2 decreases moving towards the distal end 155 at a second average rate, the second average rate being greater than the first average rate. For example, a ratio of the second average rate to the first average rate may be between 1.5:1 and 2.5:1, more specifically between 1.7:1 and 2.3:1, and even more specifically between 1.9:1 and 2.1:1. In some embodiments, the second average rate may be approximately twice the first average rate such that the first axial portion 156 tapers more rapidly along the second axis D-D than along the first axis C-C.

Referring back to FIGS. 7-8B, the first axial portion 156 of the bristle 152 will be described with reference to its overall appearance rather than its transverse cross-sectional profile. The first axial portion 156 of the body 153 of the bristle 152 comprises an outer surface 199 that comprises a first edge 167, a second edge 168, a first linear surface 169, a second linear surface 170, a third linear surface 171, a fourth linear surface 172, a first convex surface 173, and a second convex surface 174. The first edge 167 comprises the first apex 159 of the perimeter 158 of the first transverse cross-sectional profile. The second edge 168 comprises the second apex 160 of the perimeter 158 of the first transverse cross-sectional profile. The first linear surface 169 comprises the first linear section 161 of the perimeter 158 of the first transverse cross-sectional profile. The second linear surface 170 comprises the second linear section 162 of the perimeter 158 of the first transverse cross-sectional profile. The third linear surface 171 comprises the third linear section 162 of the perimeter 158 of the first transverse cross-sectional profile. The fourth linear surface 172 comprises the fourth linear section 163 of the perimeter 158 of the first transverse cross-sectional profile. The first convex surface 173 comprises the first concave section 164 of the perimeter 158 of the first transverse cross-sectional profile. Finally, the second convex surface 174 comprises the second concave section 165 of the perimeter 158 of the first transverse cross-sectional profile.

In the exemplified embodiment, each of the first, second, third, and fourth linear surfaces 169-172 are planar, non-curved surfaces. Thus, the first linear surface 169 lies on a first plane, the second linear surface 170 lies on a second plane, the third linear surface 171 lies on a third plane, and the fourth linear surface 172 lies on a fourth plane. There is no curvature in the linear surfaces in the exemplified embodiment.

As can be seen, the first and second linear surfaces 169, 170 intersect to form the first edge 167. Each of the first and second linear surfaces 169, 170 and the first edge 167 is elongated along the first axial portion 156 of the body 153 of the bristle 152 in a direction of the longitudinal axis B-B. However, the first edge 167 is non-parallel to the longitudinal axis B-B due to the tapering nature of the first axial portion 156. Similarly, the third and fourth linear surfaces 171, 172 intersect to form the second edge 168. Each of the third and fourth linear surfaces 171, 172 and the second edge 168 is elongated along the first axial portion 156 of the body 153 of the bristle 152 in a direction of the longitudinal axis B-B. However, the second edge 168 is non-parallel to the longitudinal axis B-B due to the tapering nature of the first axial portion 156. The first and second edges 167, 168 are circumferentially spaced apart from one another, and in the exemplified embodiment are located approximately 180° apart from one another. The first convex surface 173 extends between the first and third linear surfaces 169, 171 and the second convex surface 174 extends between the second and second and fourth linear surfaces 170, 172. The first, second, third, and fourth linear surfaces 169-172 are linear in a direction transverse to the longitudinal axis B-B. Each of the first and second convex surfaces 173, 174 is convex in a direction transverse to the longitudinal axis B-B. Thus, the first and second convex surfaces 173, 174 are not linear, but rather they are rounded to provide the bristle 152 with an overall look that is similar to a traditional bristle while still providing it with additional edges and linear sections to improve oral cavity cleaning.

Each of the first, second, third, and fourth linear surfaces 169-172 has a transverse width that decreases with increasing distance from the proximal end 154 of the body 153 towards the distal end 155 of the body 153. This will be described with reference to the first linear surface 169, but the description is applicable to each of the first, second, third, and fourth linear surfaces 169-172. As best seen in FIG. 8B, the first linear surface 169 has a width W1 measured in a direction transverse to the longitudinal axis B-B. The width W1 continually decreases with increasing distance from the proximal end 154 towards the distal end 155. Thus, traveling axially upward along the first axial portion 156 of the body 153, the width W1 of the first linear surface 169 (and also the widths of each of the second, third, and fourth linear surfaces 170-172) continually decreases. As a result of these decreasing widths, the first and second linear surfaces 169, 170 have a triangular shape when viewed together in a plan view (FIG. 8B) and the third and fourth linear surfaces 171, 172 have a triangular shape when viewed together in a planar view.

The first, second, third, and fourth linear surfaces 169-172 terminate at the junction between the first and second axial portions 156, 157 of the body 153 of the bristle 152. Thus, the first, second, third, and fourth linear surfaces 169-172 are located only along the first axial portion 156 but not also along the second axial portion 157. However, the first and second edges 167, 168 extend along both of the first and second axial portions 156, 157 of the body 153 of the bristle 152. The portions of the first and second edges 167, 168 that are located along the second axial portion 157 of the body 153 of the bristle 152 are simply not formed by linear surfaces, as discussed in more detail below.

Referring to FIGS. 9C, 9D, and 9E, transverse cross-sections of the second axial section 157 of the body 153 of the bristle 152 are illustrated. The second axial section 157 of the body 153 comprises a second transverse cross-sectional profile having a perimeter 175 defined by a third apex 176, a fourth apex 177, a third curved section 178, and a fourth curved section 179. The third and fourth curved sections 178, 179 intersect to form the third and fourth apexes 176, 177. Thus, in the second axial section 157, the third and fourth apexes 176, 177 are formed by the intersection of curved sections rather than the intersection of linear sections as takes place within the first axial section 156. This is because the linear sections 169-172 terminate prior to the second axial section 157 of the body 153.

Referring back to FIGS. 7-8B, the first and second edges 167, 168 continue into the second axial section 157. Thus, the portion of the first edge 167 that is in the second axial section 157 of the body 153 comprises the third apex 176 of the perimeter 175 of the second transverse cross-sectional profile and the portion of the first edge 168 that is in the second axial section 157 of the body 153 comprises the fourth apex 177 of the perimeter 175 of the second transverse cross-sectional profile. Similarly, the first and second convex surfaces 173, 174 also continue into the second axial section 157. Thus, the first and second convex surfaces 173, 174 comprise the third and fourth curved sections 178, 178 of the perimeter 175 of the second transverse cross-sectional profile, respectively.

Thus, the first convex surface 173 extends between the first and third linear surfaces 169, 171 within the first axial portion 156 of the body 153 and between the first and second edges 167, 168 within the second axial portion 157 of the body 153. Similarly, the second convex surface 174 extends between the second and fourth linear surfaces 170, 172 within the first axial portion 156 of the body 153 and between the first and second edges 167, 168 within the second axial portion 157 of the body 153. Thus, within the first axial portion 156, the first and second edges 167, 168 are formed by the intersection of the first and second linear surfaces 169, 170 and the third and fourth linear surfaces 171, 172, respectively. Within the second axial portion 157, the first and second edges 167, 168 are formed by the intersection of the first and second convex surfaces 173, 174.

As is apparent from a review of the figures, the second axial portion 157 tapers much more rapidly than the first axial portion 156. Specifically, the first axial portion 156 of the body 153 tapers at a first average rate and the second axial portion 157 of the body 153 tapers at a second average rate, the second average rate being greater than the first average rate. In fact, the rate at which both the first and second diameters D1, D2 taper increase in the second axial portion 157 relative to the first axial portion 156. Thus, the distal end 155 of the body 153 is flattened and pointed. At the distal end 155 of the body 153 (which is also the distal end of the second axial portion 157 of the body 153), the body 153 has a transverse-cross-sectional profile such as that illustrated in FIG. 9E (the shape is similar to a football). It should be noted that any transverse cross-section of the second axial section 157 comprises the shape of the second transverse cross-sectional profile as illustrated in FIGS. 9C-9E.

More specifically, in certain embodiments a ratio of the average rate at which D1 decreases in the second axial portion 157 relative to the average rate at which D1 decreases in the first axial portion 156 is between 3:1 and 6:1. Furthermore, in certain embodiments a ratio of the average rate at which D2 decreases in the second axial portion 157 relative to the average rate at which D2 decreases in the first axial portion 156 is between 1.1:1 and 2.5:1. It should be noted that within the second axial portion 157, D1 decreases faster than D2 decreases as the second axial portion 157 extends from the first axial portion 156 towards the distal end 155 of the body 153. Despite this, D1 remains greater than D2 at any axial location along the second axial portion 156 of the body 153.

As set forth herein above, each of the first and second axial portions 156, 157 of the body 153 are tapered. Thus, in some embodiments the first and second axial portions 156, 157 of the body 153 may be collectively referred to as a tapered portion of the body 153.

Figure 14:
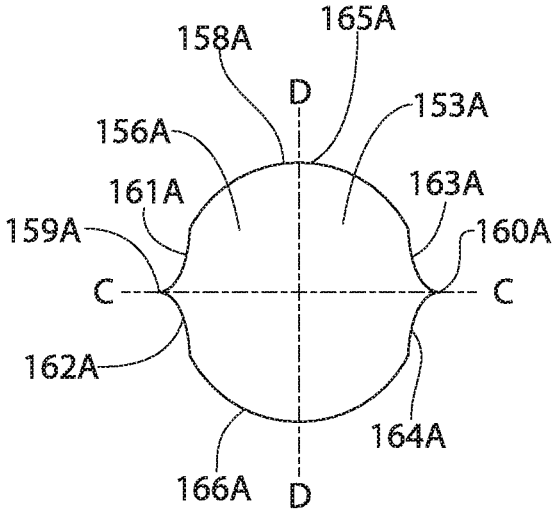
FIG. 14 is an alternative cross-sectional view taken along line IXA-IXA of FIG. 8B.

Referring to FIG. 14, an alternative to the cross-sectional illustrated in FIG. 9A is provided. The features of FIG. 14 are numbered in an identical manner to the features of FIG. 9A except that the suffix "A" is provided after each numeral. Thus, other than the differences mentioned herein below, the description of FIG. 9A is equally applicable to FIG. 14. In FIG. 14, the cross-section of the first axial section 156 of the bristle 152 is illustrated. In this embodiment, everything is the same as with the previously described embodiment except that each of the first, second, third, and fourth linear sections 161-164 are no longer linear. Rather, these are instead illustrated as a first concave section 161A, a second concave section 162A, a third concave section 163A, and a fourth concave section 164A. Thus, in this alternative embodiment the first axial section 156 has this minor difference in shape in that it has concave sections 161A-164A rather than linear sections 161-164.

Figure 10:
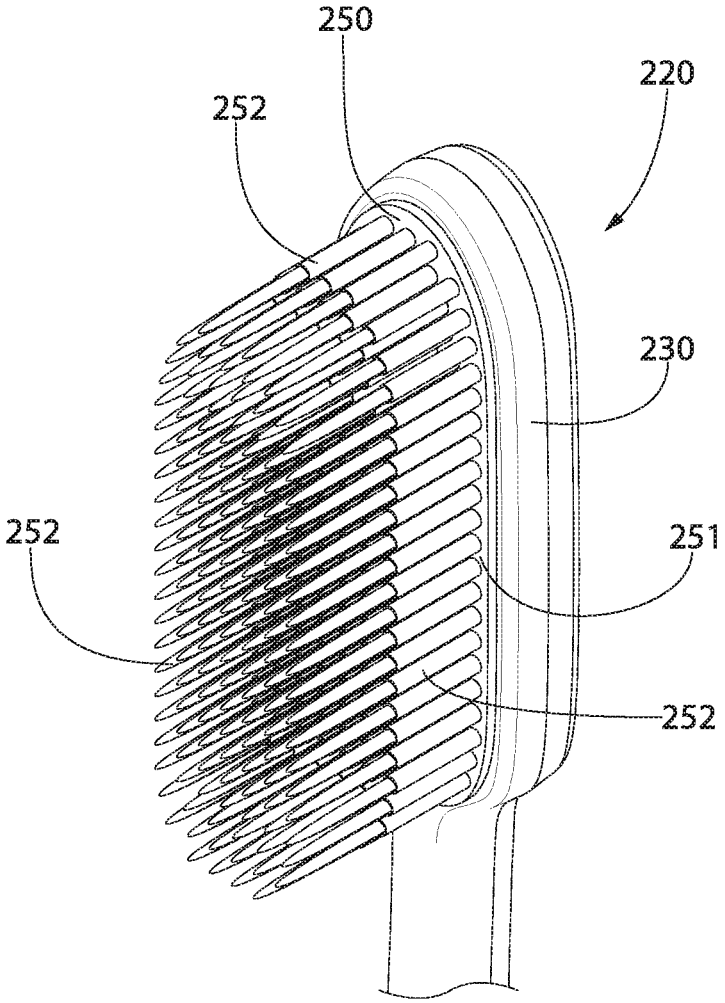
FIG. 10 is a close-up view of a head of an oral care implement in accordance with another embodiment of the present invention.

Referring to FIG. 10, a head 220 of an oral care implement is illustrated in accordance with an alternative embodiment of the present invention. The head 220 includes a support structure 230 and a monolithic cleaning unit 250 comprising a pad 251 and a plurality of bristles 252. The head 220 is identical to the head 120 except with respect to the shape of the bristles 252. Thus, the description of the head 120 is applicable to the head 220 except for the differences in the bristle shape, which are set forth below.

Figure 11:
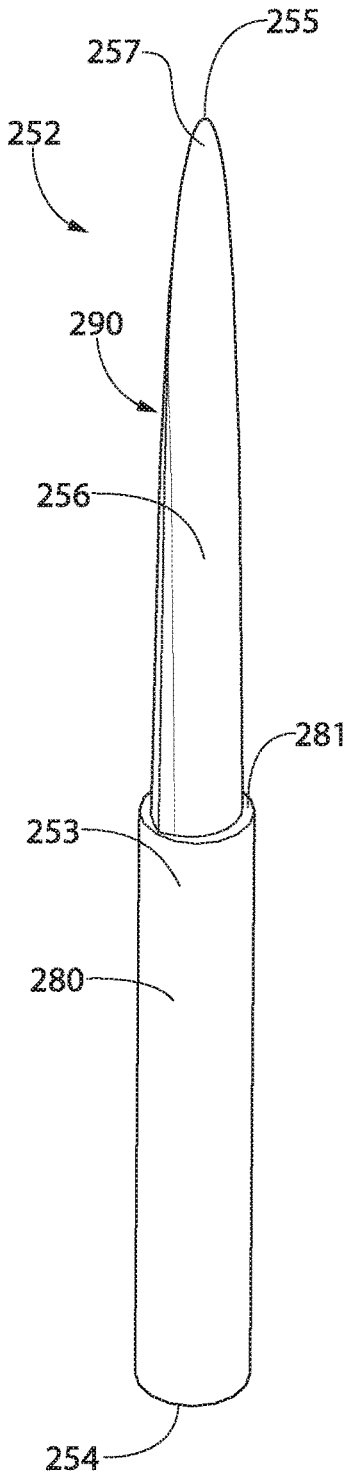
FIG. 11 is a perspective view of a bristle of the oral care implement of FIG. 10.
Figure 12A:
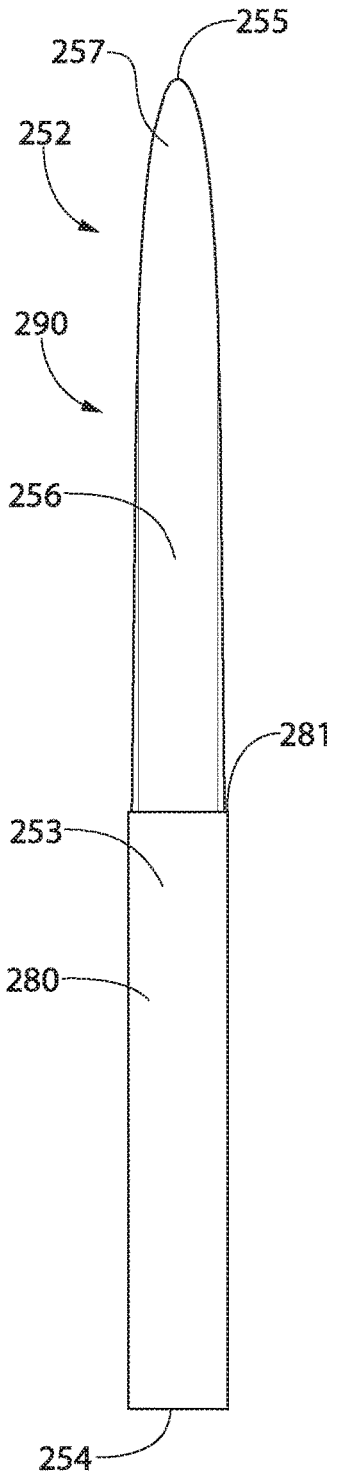
FIG. 12A is a front view of the bristle of FIG. 11.
Figure 12B:
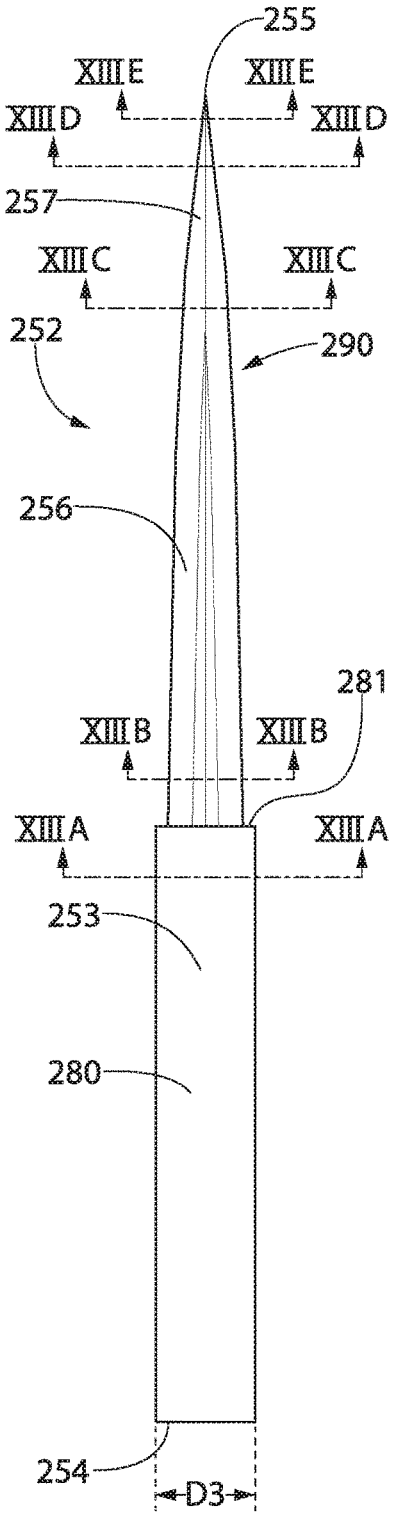
FIG. 12B is a side view of the bristle of FIG. 11.
Figure 13A:
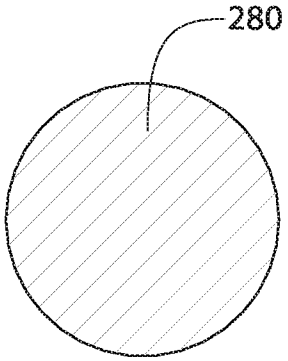
FIG. 13A is a cross-sectional view taken along line XIIIA-XIIIA of FIG. 12B.
Figure 13B:
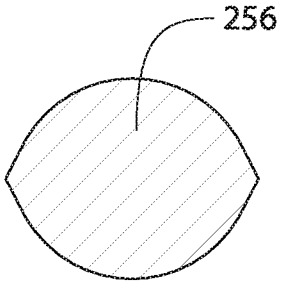
FIG. 13B is a cross-sectional view taken along line XIIIB-XIIIB of FIG. 12B.
Figure 13C:
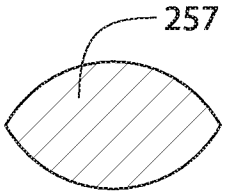
FIG. 13C is a cross-sectional view taken along line XIIIC-XIIIC of FIG. 12B.
Figure 13D:
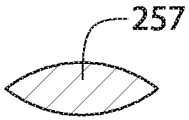
FIG. 13D is a cross-sectional view taken along line XIIID-XIIID of FIG. 12B.
Figure 13E:
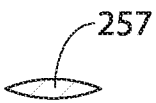
FIG. 13E is a cross-sectional view taken along line XIIIE-XIIIE of FIG. 12B.

Referring to FIGS. 11-12B, one of the bristles 252 is illustrated. The bristle 252 comprises a body 253 extending from a proximal end 254 to a distal end 255. The body 253 comprises a cylindrical base portion 280 (also referred to herein as a third axial section) and a tapered portion 290. The tapered portion 290 includes a first axial portion 256 and a second axial portion 257 that are identical to the first and second axial portion 156, 157 of the body 153 with the exception that their dimensions may be different due to the addition of the cylindrical base portion 280 in the bristle 252. Specifically, because the bristle 252 includes the cylindrical base portion 280, the first and second axial portion 256, 257 may have a reduced length and/or width relative to the first and second axial portion 156, 157 of the bristle 152. The details of the first and second axial portion 256, 257 will not be described herein, it being understood that the description of the first and second axial portion 156, 157 is applicable.

In this embodiment, the cylindrical base portion 280 extends from the proximal end 254 of the body 253 to a top end 281 of the cylindrical base portion 280. The tapered portion 290, and more specifically the first axial portion 256 thereof, extends directly from the top end 281 of the cylindrical base portion 280. Thus, the first axial portion 256 is located between the cylindrical base portion 280 and the second axial portion 257. The cylindrical base portion 280 is cylindrical in shape and has a round cross-section in the exemplified embodiment, but it could be oval in other embodiments. Furthermore, the cylindrical base portion 280 need not be cylindrical in all embodiments but instead could be conical and tapered or it could have a polygonal shape (i.e., octagonal, hexagonal, etc.). In embodiments that include the base portion 280, it is merely desirable that the base portion 280 form a shoulder at its top surface that surrounds the tapered portion 290 of the bristle 252.

The cylindrical base portion 280 has a constant diameter in the exemplified embodiment such that the cylindrical base portion 280 is not tapered. However, the invention is not to be so limited and it is entirely possible that the cylindrical base portion 280 could be tapered in alternative embodiments. Regardless, the cylindrical base portion 280 has a third diameter D3 at the top end 281 thereof. Furthermore, the first axial portion 256 has a maximum diameter located adjacent to the end 281 of the cylindrical base portion 280. The third diameter D3 of the cylindrical base portion 280 is greater than the maximum diameter of the first axial portion 256. As a result, the top end 281 of the cylindrical base portion 280 forms a shoulder of the body 253. Specifically, a portion of the top end 281 of the cylindrical base portion 280 remains exposed such that the junction between the cylindrical base portion 280 and the first axial portion 256 of the tapered portion 290 is a stepped surface. The shoulder formed by the top end 281 may be an annular shoulder that circumferentially surrounds the tapered portion 290 of the body 253.

As illustrated in FIGS. 13A-13E, the first axial portion 256 and the second axial portion 257 have different transverse cross-sectional shapes. Furthermore, the cylindrical base portion 280 also has a transverse cross-sectional shape that differs from the transverse cross-sectional shapes of each of the first and second axial portions 256, 257. Specifically, the cylindrical base portion 280 has a circular or oval transverse cross-sectional shape, the first axial portion 256 has a lemon-like transverse cross-sectional shape, and the second axial portion 257 has a football-like transverse cross-sectional shape.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

Exemplary Claim Set

Exemplary Claim 1. A bristle for an oral care implement comprising: a body extending along a longitudinal axis from a proximal end to a distal end, the body comprising: a first axial portion comprising a first transverse cross-sectional profile having a perimeter defined by a first linear section and a second linear section that intersect to form a first apex, a third linear section and a fourth linear section that intersect to form a second apex, a first curved section extending between the first and third linear sections, and a second curved section extending between the second and fourth linear sections; and a second axial portion comprising a second transverse cross-sectional profile having a perimeter defined by a third apex, a fourth apex, a third curved section, and a fourth curved section, the third and fourth curved sections intersecting to form the third and fourth apexes.

Exemplary Claim 2. The bristle according to Exemplary Claim 1 wherein the first transverse cross-sectional profile of the first axial portion comprises a first axis and a second axis that is perpendicular to the first axis, the first and second apexes of the perimeter of the first transverse cross-sectional profile being aligned along the first axis and located on opposite sides of the second axis.

Exemplary Claim 3. The bristle according to Exemplary Claim 2 wherein the first and second linear sections of the perimeter of the first transverse cross-sectional profile are located on a first side of the second axis and the third and fourth linear sections of the perimeter of the first transverse cross-sectional profile are located on a second side of the second axis that is opposite the first side of the second axis, and wherein the first and third linear sections and the first curved section of the perimeter of the first transverse cross-sectional profile are located on a first side of the first axis and the second and fourth linear sections and the second curved section of the perimeter of the first transverse cross-sectional profile are located on a second side of the first axis that is opposite the first side of the first axis.

Exemplary Claim 4. The bristle according to Exemplary Claim 3 wherein the second axis intersects each of the first and second curved sections of the perimeter of the first transverse cross-sectional profile.

Exemplary Claim 5. The bristle according to any one of Exemplary Claims 1 to 4 wherein the first axial portion of the body comprises a first edge that includes the first apex of the perimeter of the first transverse cross-sectional profile and a second edge that includes the second apex of the perimeter of the first transverse cross-sectional profile, the first and second edges elongated along the first axial portion of the body in a direction of the longitudinal axis and circumferentially spaced apart from one another.

Exemplary Claim 6. The bristle according to Exemplary Claim 5 wherein the first axial portion of the body comprises a first linear surface that includes the first linear section of the perimeter of the first transverse cross-sectional profile and a second linear surface that includes the second linear section of the perimeter of the first transverse cross-sectional profile, the first and second linear surfaces elongated along the first axial portion of the body in a direction of the longitudinal axis, and wherein the first edge is located between the first and second linear surfaces.

Exemplary Claim 7. The bristle according to any one of Exemplary Claims 5 to 6 wherein the first axial portion of the body comprises a third linear surface that includes the third linear section of the perimeter of the first transverse cross-sectional profile and a fourth linear surface that includes the fourth linear section of the perimeter of the first transverse cross-sectional profile, the third and fourth linear surfaces elongated along the first axial portion of the body in a direction of the longitudinal axis, and wherein the second edge is located between the third and fourth linear surfaces.

Exemplary Claim 8. The bristle according to any one of Exemplary Claims 6 to 7 wherein the first axial portion of the body comprises a first convex surface that includes the first curved section of the perimeter of the first transverse cross-sectional profile and a second convex surface that includes the second curved section of the perimeter of the first transverse cross-sectional profile, each of the first and second convex surfaces being elongated along the first axial portion of the body in a direction of the longitudinal axis and being convex in a direction transverse to the longitudinal axis.

Exemplary Claim 9. The bristle according to any one of Exemplary Claims 6 to 8 wherein the first linear surface has a first width measured in a direction transverse to the longitudinal axis and the second linear surface has a second width measured in a direction transverse to the longitudinal axis, and wherein each of the first and second widths continually decreases with increasing distance from a first end of the first axial portion towards a second end of the first axial portion, the second end of the first axial portion being adjacent to the second axial portion of the body.

Exemplary Claim 10. The bristle according to any one of Exemplary Claims 1 to 9 wherein the first axial portion of the body tapers at a first average rate and the second axial portion of the body tapers at a second average rate, the second average rate being greater than the first average rate.

Exemplary Claim 11. The bristle according to any one of Exemplary Claims 1 to 10 wherein the body has a first taper profile when viewed from a first side thereof and a second taper profile when viewed from a second side thereof, the first and second taper profiles being different.

Exemplary Claim 12. The bristle according to Exemplary Claim 11 wherein the body is end-rounded when viewed from the first side thereof and terminates in a tapered tip when viewed from the second side thereof.

13. The bristle according to any one of Exemplary Claims 1 to 12 wherein the first axial portion of the body has a first diameter measured along a first axis that is transverse to the longitudinal axis and a second diameter measured along a second axis that is transverse to the longitudinal axis and perpendicular to the first axis, the first diameter being greater than the second diameter at any axial location of the first axial portion.

Exemplary Claim 14. The bristle according to Exemplary Claim 13 wherein the first axial portion of the body extends along the longitudinal axis from a first end to a second end, the second end being adjacent to the second axial portion of the body, the first diameter of the first axial portion decreasing at a first average rate from the first end to the second end and the second diameter of the first axial portion decreasing at a second average rate from the first end to the second end, the second average rate being greater than the first average rate.

Exemplary Claim 15. The bristle according to any one of Exemplary Claims 1 to 14 wherein the second axial portion of the body comprises the distal end of the body and wherein the body further comprises a third axial portion comprising the proximal end of the body, the first axial portion being located between the second and third axial portions.

Exemplary Claim 16. The bristle according to Exemplary Claim 15 wherein the third axial portion of the body is cylindrical.

17. The bristle according to any one of Exemplary Claims 15 to 16 wherein the third axial portion extends from a first end at the proximal end of the body to a second end, the third axial portion having a third diameter at the second end, the first axial portion extending from a first end that is adjacent to the second end of the third axial portion to a second end that is adjacent to the second axial portion, the first axial portion having a maximum diameter at the first end, the third diameter of the third axial portion being greater than the maximum diameter of the first axial portion.

Exemplary Claim 18. The bristle according to Exemplary Claim 17 wherein the body comprises a stepped surface at the junction between the first and third axial portions such that the second end of the third axial portion forms a shoulder.

Exemplary Claim 19. The bristle according to any one of Exemplary Claims 1 to 18 wherein the body is injection molded and formed of an elastomeric material.

Exemplary Claim 20. An oral care implement comprising: a head; and a plurality of the bristles according to any one of Exemplary Claims 1 to 19 extending from the head.

Exemplary Claim 21. The oral care implement according to Exemplary Claim 20 further comprising a monolithic cleaning unit comprising a pad and the plurality of the bristles extending from the pad, and wherein the pad is mounted to the head.

Exemplary Claim 22. A bristle for an oral care implement comprising: a body extending along a longitudinal axis from a proximal end to a distal end, the body comprising: a base portion comprising the proximal end of the body; a first axial portion extending from the base portion, the first axial portion comprising at least one edge elongated along the longitudinal axis and at least one curved surface; and a second axial portion extending from the first axial portion and comprising the distal end of the body, the second axial portion comprising at least one edge elongated along the longitudinal axis and at least one curved surface.

Exemplary Claim 23. The bristle according to Exemplary Claim 22 wherein the base portion has a first transverse cross-sectional shape, the first axial portion has a second transverse cross-sectional shape, and the second axial portion has a third transverse cross-sectional shape, and wherein each of the first, second, and third transverse cross-sectional shapes is different.

Exemplary Claim 24. The bristle according to any one of Exemplary Claims 22 to 23 wherein the base portion of the body is cylindrical and has a constant diameter and wherein each of the first and second axial portions are tapered having diameters that decrease with increasing distance away from the cylindrical base portion towards the distal end of the body.

Exemplary Claim 25. The bristle according to any one of Exemplary Claims 22 to 24 wherein the first axial portion extends directly from a top end of base portion, the top end of the base portion having a diameter that is greater than a maximum diameter of the first axial portion so that a portion of the top end of the base portion forms an exposed shoulder of the body.

Exemplary Claim 26. The bristle according to any one of Exemplary Claims 22 to 25 wherein the first axial portion comprises a first transverse cross-sectional shape having a perimeter defined by a first linear section and a second linear section that intersect to form a first apex, a third linear section and a fourth linear section that intersect to form a second apex, a first curved section extending between the first and third linear sections, and a second curved section extending between the second and fourth linear sections.

Exemplary Claim 27. The bristle according to any one of Exemplary Claims 22 to 26 wherein the second axial portion comprises a second transverse cross-sectional shape having a perimeter defined by a third apex, a fourth apex, a third curved section, and a fourth curved section, the third and fourth curved sections intersecting to form the third and fourth apexes.

Exemplary Claim 28. The bristle according to Exemplary Claim 26 or Exemplary Claim 27 wherein any transverse cross-section of the first axial section comprises the first transverse cross-sectional shape and wherein any transverse cross-section of the second axial section comprises the second transverse cross-sectional shape.

Exemplary Claim 29. The bristle according to any one of Exemplary Claims 22 to 28 wherein the first axial portion of the body tapers at a first average rate and the second axial portion of the body tapers at a second average rate, the second average rate being greater than the first average rate.

Exemplary Claim 30. The bristle according to any one of Exemplary Claims 22 to 29 wherein the base portion of the body has a round cross-sectional shape and is non-tapered.

Exemplary Claim 31. The bristle according to any one of Exemplary Claims 22 to 30 wherein the first axial portion of the body has a first diameter measured along a first axis that is transverse to the longitudinal axis and a second diameter measured along a second axis that is transverse to the longitudinal axis and perpendicular to the first axis, the first diameter being greater than the second diameter at any axial location of the first axial portion.

Exemplary Claim 32. The bristle according to Exemplary Claim 31 wherein the first axial portion of the body extends along the longitudinal axis from a first end to a second end, the first end being adjacent to the cylindrical base portion and the second end being adjacent to the second axial portion of the body, the first diameter of the first axial portion decreasing at a first average rate from the first end to the second end and the second diameter of the first axial portion decreasing at a second average rate from the first end to the second end, the second average rate being greater than the first average rate.

Exemplary Claim 33. The bristle according to any one of Exemplary Claims 22 to 32 wherein the body is injection molded out of an elastomeric material.

Exemplary Claim 34. An oral care implement comprising: a head; and a plurality of the bristles according to any one of Exemplary Claims 22 to 33 extending from the head.

Exemplary Claim 35. The oral care implement according to Exemplary Claim 34 further comprising a monolithic cleaning unit comprising a pad and the plurality of the bristles extending from the pad, and wherein the pad is mounted to the head.

Exemplary Claim 36. A bristle for an oral care implement comprising: an elastomeric body extending along a longitudinal axis from a proximal end to a distal end, the elastomeric body comprising: a base portion extending from the proximal end of the elastomeric body to a top end; and a tapered portion extending from the top end of the base portion to the distal end of the elastomeric body, the top end of the base portion forming an annular shoulder that circumferentially surrounds the tapered portion, the tapered portion comprising a first edge and a second edge that are circumferentially spaced apart from one another, the first and second edges being elongated along the tapered portion in a direction of the longitudinal axis.

Exemplary Claim 37. The bristle according to Exemplary Claim 36 wherein the tapered portion further comprises: a first linear surface and a second linear surface that intersect to form a first portion of the first edge; a third linear surface and a fourth linear surface that intersect to form a first portion of the second edge; a first convex surface extending between the first and third linear surfaces; and a second convex surface extending between the second and fourth linear surfaces.

Exemplary Claim 38. The bristle according to Exemplary Claim 37 wherein the tapered portion of the body has a first axial portion extending from the top end of the portion to an end of the first axial portion and a second axial portion extending from the end of the first axial portion to the distal end of the body, the first, second, third, and fourth linear surfaces extending only along the first axial portion of the tapered portion of the body and the first and second edges extending along both of the first and second axial portions of the tapered portion of the body.

Exemplary Claim 39. The bristle according to Exemplary Claim 38 wherein the first convex surface extends between the first and third linear surfaces within the first axial portion of the tapered portion of the body and between the first and second edges within the second axial portion of the tapered portion of the body, and wherein the second convex surface extends between the second and fourth linear surfaces within the first axial portion of the tapered portion of the body and between the first and second edges within the second axial portion of the tapered portion of the body.

Exemplary Claim 40. The bristle according to any one of Exemplary Claims 38 to 39 wherein the first and second convex surfaces intersect to form a second portion of each of the first and second edges, the first portion of the first and second edges located along the first axial portion of the tapered portion of the body and the second portion of the first and second edges located along the second axial portion of the tapered portion of the body.

Exemplary Claim 41. A bristle for an oral care implement comprising: a body extending along a longitudinal axis from a proximal end to a distal end, the body comprising a transverse cross-sectional profile having a perimeter defined by a first linear section and a second linear section that intersect to form a first apex, a third linear section and a fourth linear section that intersect to form a second apex, a first curved section extending between the first and third linear sections, and a second curved section extending between the second and fourth linear sections.

Exemplary Claim 42. The bristle according to Exemplary Claim 41, wherein the body comprises a base portion and a tapered portion extending from the base portion, the base portion having a cylindrical cross-sectional profile and comprising the proximal end of the body, and the first transverse cross-sectional profile being located along the tapered portion of the body.

Exemplary Claim 43. An oral care implement comprising: a head; and a plurality of the bristles according to any one of Exemplary Claims 41 to 42 extending from the head, the plurality of bristles being integrally formed as a part of a monolithic cleaning unit.

Exemplary Claim 44. A bristle for an oral care implement comprising: a body extending along a longitudinal axis from a proximal end to a distal end, the body comprising a first axial portion comprising at least one edge elongated in a direction of the longitudinal axis and at least one curved surface.

Exemplary Claim 45. The bristle according to Exemplary Claim 44 wherein the at least one edge comprises a first edge and a second edge that are circumferentially spaced apart from one another, and wherein the at least one curved surface is located between the first and second edges.

Exemplary Claim 46. The bristle according to Exemplary Claim 45 wherein the first axial portion further comprises a first linear surface and a second linear surface that intersect to form the first edge and a third linear surface and a fourth linear surface that intersect to form the second edge.

Exemplary Claim 47. The bristle according to Exemplary Claim 46 wherein the at least one curved surface comprises a first curved surface extending from the first linear surface to the third linear surface and a second curved surface extending from the second linear surface to the fourth linear surface.

Exemplary Claim 48. The bristle according to any one of Exemplary Claims 44 to 47 wherein the body further comprises a second axial section extending from the first axial section, the second axial section comprising a third curved surface and a fourth curved surface that intersect to form a third edge and a fourth edge.

Exemplary Claim 49. The bristle according to Exemplary Claim 48 wherein each of the first and second axial sections of the body are tapered.

Exemplary Claim 50. A bristle for an oral care implement comprising: a body extending along a longitudinal axis from a proximal end to a distal end, the body comprising: a first axial portion comprising a first transverse cross-sectional profile having a perimeter defined by a first concave section and a second concave section that intersect to form a first apex, a third concave section and a fourth concave section that intersect to form a second apex, a first convex section extending between the first and third concave sections, and a second convex section extending between the second and fourth concave sections.

Exemplary Claim 51. The bristle according to claim 50 wherein the body further comprises: a second axial portion comprising a second transverse cross-sectional profile having a perimeter defined by a third apex, a fourth apex, a third convex section, and a fourth convex section, the third and fourth convex sections intersecting to form the third and fourth apexes.

What is claimed is:

1. A bristle for an oral care implement comprising:

a body extending along a longitudinal axis from a proximal end to a distal end, the body comprising:

a first axial portion comprising a first transverse cross-sectional profile having a perimeter defined by a first linear section and a second linear section that intersect to form a first apex, a third linear section and a fourth linear section that intersect to form a second apex, a first curved section extending between the first and third linear sections, and a second curved section extending between the second and fourth linear sections; and a second axial portion comprising a second transverse cross-sectional profile having a perimeter defined by a third apex, a fourth apex, a third curved section, and a fourth curved section, the third and fourth curved sections intersecting to form the third and fourth apexes.

2. The bristle according to claim 1 wherein the first transverse cross-sectional profile of the first axial portion comprises a first axis and a second axis that is perpendicular to the first axis, the first and second apexes of the perimeter of the first transverse cross-sectional profile being aligned along the first axis and located on opposite sides of the second axis.

3. The bristle according to claim 2 wherein the first and second linear sections of the perimeter of the first transverse cross-sectional profile are located on a first side of the second axis and the third and fourth linear sections of the perimeter of the first transverse cross-sectional profile are located on a second side of the second axis that is opposite the first side of the second axis, and wherein the first and third linear sections and the first curved section of the perimeter of the first transverse cross-sectional profile are located on a first side of the first axis and the second and fourth linear sections and the second curved section of the perimeter of the first transverse cross-sectional profile are located on a second side of the first axis that is opposite the first side of the first axis, and wherein the second axis intersects each of the first and second curved sections of the perimeter of the first transverse cross-sectional profile.

4. The bristle according to claim 1 wherein the first axial portion of the body comprises a first edge that includes the first apex of the perimeter of the first transverse cross-sectional profile and a second edge that includes the second apex of the perimeter of the first transverse cross-sectional profile, the first and second edges elongated along the first axial portion of the body in a direction of the longitudinal axis and circumferentially spaced apart from one another.

5. The bristle according to claim 4 wherein the first axial portion of the body comprises a first linear surface that includes the first linear section of the perimeter of the first transverse cross-sectional profile and a second linear surface that includes the second linear section of the perimeter of the first transverse cross-sectional profile, the first and second linear surfaces elongated along the first axial portion of the body in a direction of the longitudinal axis, and wherein the first edge is located between the first and second linear surfaces.

6. The bristle according to claim 1 wherein the first axial portion of the body tapers at a first average rate and the second axial portion of the body tapers at a second average rate, the second average rate being greater than the first average rate.

7. The bristle according to claim 1 wherein the body has a first taper profile when viewed from a first side thereof and a second taper profile when viewed from a second side thereof, the first and second taper profiles being different.

8. The bristle according to claim 1 wherein the first axial portion of the body has a first diameter measured along a first axis that is transverse to the longitudinal axis and a second diameter measured along a second axis that is transverse to the longitudinal axis and perpendicular to the first axis, the first diameter being greater than the second diameter at any axial location of the first axial portion, and wherein the first axial portion of the body extends along the longitudinal axis from a first end to a second end, the second end being adjacent to the second axial portion of the body, the first diameter of the first axial portion decreasing at a first average rate from the first end to the second end and the second diameter of the first axial portion decreasing at a second average rate from the first end to the second end, the second average rate being greater than the first average rate.

9. The bristle according to claim 1 wherein the second axial portion of the body comprises the distal end of the body and wherein the body further comprises a third axial portion comprising the proximal end of the body, the first axial portion being cylindrical and being located between the second and third axial portions, wherein the third axial portion extends from a first end at the proximal end of the body to a second end, the third axial portion having a third diameter at the second end, the first axial portion extending from a first end that is adjacent to the second end of the third axial portion to a second end that is adjacent to the second axial portion, the first axial portion having a maximum diameter at the first end, the third diameter of the third axial portion being greater than the maximum diameter of the first axial portion, and wherein the body comprises a stepped surface at the junction between the first and third axial portions such that the second end of the third axial portion forms a shoulder.

10. The bristle according to claim 1 wherein the body is injection molded and formed of an elastomeric material.

11. A bristle for an oral care implement comprising:

a body extending along a longitudinal axis from a proximal end to a distal end, the body comprising:

a base portion comprising the proximal end of the body;

a first axial portion extending from the base portion, the first axial portion comprising at least one edge elongated in a direction of the longitudinal axis, at least one curved surface, and a first transverse cross-sectional shape having a perimeter defined by a first linear section, a second linear section, a third linear section, and a fourth linear section, wherein the at least one edge comprises an apex formed between the first linear section and the second linear section and the at least one curved surface is formed between the first linear section and the third linear section, wherein the at least one curved surface extends tangentially from the first linear section and extends tangentially from the third linear section; and a second axial portion extending from the first axial portion and comprising the distal end of the body, the second axial portion comprising at least one edge elongated in a direction of the longitudinal axis and at least one curved surface.

12. The bristle according to claim 11 wherein the base portion of the body is cylindrical and has a constant diameter and wherein each of the first and second axial portions are tapered having diameters that decrease with increasing distance away from the cylindrical base portion towards the distal end of the body.

13. The bristle according to claim 11 wherein the first axial portion extends directly from a top end of the base portion, the top end of the base portion having a diameter that is greater than a maximum diameter of the first axial portion so that a portion of the top end of the base portion forms an exposed shoulder of the body.

14. The bristle according to claim 11 wherein the second axial portion comprises a second transverse cross-sectional shape having a perimeter defined by a third apex, a fourth apex, a third curved section, and a fourth curved section, the third and fourth curved sections intersecting to form the third and fourth apexes, and wherein any transverse cross-section of the first axial section comprises the first transverse cross-sectional shape and wherein any transverse cross-section of the second axial section comprises the second transverse cross-sectional shape.

15. The bristle according to claim 11 wherein the first axial portion of the body tapers at a first average rate and the second axial portion of the body tapers at a second average rate, the second average rate being greater than the first average rate, and wherein the base portion of the body has a round cross-sectional shape and is non-tapered.

16. The bristle according to claim 11 wherein the first axial portion of the body has a first diameter measured along a first axis that is transverse to the longitudinal axis and a second diameter measured along a second axis that is transverse to the longitudinal axis and perpendicular to the first axis, the first diameter being greater than the second diameter at any axial location of the first axial portion, and wherein the first axial portion of the body extends along the longitudinal axis from a first end to a second end, the first end being adjacent to the cylindrical base portion and the second end being adjacent to the second axial portion of the body, the first diameter of the first axial portion decreasing at a first average rate from the first end to the second end and the second diameter of the first axial portion decreasing at a second average rate from the first end to the second end, the second average rate being greater than the first average rate.

17. A bristle for an oral care implement comprising:

an elastomeric body extending along a longitudinal axis from a proximal end to a distal end, the elastomeric body comprising:

a base portion extending from the proximal end of the elastomeric body to a top end; and a tapered portion extending from the top end of the base portion to the distal end of the elastomeric body, the top end of the base portion forming an annular shoulder that circumferentially surrounds the tapered portion, the tapered portion comprising a first edge and a second edge that are circumferentially spaced apart from one another, the first and second edges extending along the tapered portion in a direction of the longitudinal axis; and wherein the tapered portion further comprises a first linear surface and a second linear surface that intersect to form a first portion of the first edge; a third linear surface and a fourth linear surface that intersect to form a first portion of the second edge; a first convex surface extending between the first and third linear surfaces; and a second convex surface extending between the second and fourth linear surfaces.

18. The bristle according to claim 17 wherein the tapered portion of the body has a first axial portion extending from the top end of the base portion to an end of the first axial portion and a second axial portion extending from the end of the first axial portion to the distal end of the body, the first, second, third, and fourth linear surfaces extending only along the first axial portion of the tapered portion of the body and the first and second edges extending along both of the first and second axial portions of the tapered portion of the body.

19. The bristle according to claim 18 wherein the first convex surface extends between the first and third linear surfaces within the first axial portion of the tapered portion of the body and between the first and second edges within the second axial portion of the tapered portion of the body, and wherein the second convex surface extends between the second and fourth linear surfaces within the first axial portion of the tapered portion of the body and between the first and second edges within the second axial portion of the tapered portion of the body, and wherein the first and second convex surfaces intersect to form a second portion of each of the first and second edges, the first portion of the first and second edges located along the first axial portion of the tapered portion of the body and the second portion of the first and second edges located along the second axial portion of the tapered portion of the body.

* * * * *